US005101233A

United States Patent [19]

Ito et al.

[11] Patent Number: 5,101,233

[45] Date of Patent: Mar. 31, 1992

[54] ELECTROPHOTOGRAPHIC RECORDING APPARATUS INDICATING A WEAR RATE FOR CONSUMABLE PARTS

[75] Inventors: Katsuyuki Ito; Naoji Akutsu; Takehiko Okubo; Koichi Negishi; Kazuhiko Itoh, all of Tokyo, Japan

[73] Assignee: Oki Electric Industry Co., Ltd., Tokyo, Japan

[21] Appl. No.: 654,501

[22] Filed: Feb. 13, 1991

[30] Foreign Application Priority Data

Feb. 15, 1990 [JP] Japan ..... 2-32501
Feb. 19, 1990 [JP] Japan ..... 2-36250

[51] Int. Cl.[5] ..... G03G 21/00

[52] U.S. Cl. ..... 355/209; 355/203; 355/204

[58] Field of Search ..... 355/203, 204, 206, 208, 355/209, 200

[56] References Cited

U.S. PATENT DOCUMENTS 4,496,237 1/1985 Schron .
4,707,748 11/1987 Ohtsuka et al. .
4,751,484 6/1988 Matsumoto et al. .
4,860,052 8/1989 Ito et al. ..... 355/209

FOREIGN PATENT DOCUMENTS 62-36217 8/1987 Japan .
0231269 10/1987 Japan ..... 355/209

*Primary Examiner*—A. T. Grimley
*Assistant Examiner*—Sandra L. Hoffman
*Attorney, Agent, or Firm*—Spencer and Frank

[57] ABSTRACT

In an electrophotographic recording device which includes a number of consumable parts, there is provided a first memory for storing a currently integrated total number of prints, and a number of prints at replacement of each consumable part. A second memory stores a number of lifetime prints, which is a conversion of the life of each part into a number of prints. A processor performs a first calculation to calculate a number of prints for replaced consumable parts after such replacement and a second calculation to calculate a wear rate of the replaced consumable parts from the number of lifetime prints read out from the second memory, and from the number of prints calculated by the first calculation. An indication section indicates the wear rate obtained from the second calculation. The number of prints stored in the first memory for the consumable parts at replacement is written into the current total number of prints.

8 Claims, 9 Drawing Sheets

| NAME OF COMPONENT | NUMBER OF LIFETIME PRINTS |
|---|---|
| | $A_i$ |
| PHOTOSENSITIVE ELEMENT | 15000 |
| CHARGING DEVICE | 10000 |
| ⋮ | ⋮ |
| FIXER | 30000 |
| ⋮ | ⋮ |

FIG. 4

ELECTROPHOTOGRAPHIC RECORDING APPARATUS INDICATING A WEAR RATE FOR CONSUMABLE PARTS

BACKGROUND OF THE INVENTION

1. Field of the Invention

The present invention relates to an electrophotographic recording apparatus, and more particularly to a page counting device which indicates the service life of parts and components that receive wear and tear because of printing operations.

2. Description of the Prior Art

An electrophotographic recording apparatus usually comprises a photosensitive element drum, a fixing roller, a transport belt, and other consumable parts. When these parts become worn out, they are replaced with new parts. The service life of these parts is previously determined as the number of prints that can be printed during the life of these parts. The number of prints is hereinafter called the "total lifetime prints". This number is compared with the number of prints that have been printed since the last part replacement (hereinafter called the "number of post-replacement prints") to indicate the remaining lifetime of the parts.

According to Japanese Patent Application Publication No. 62-36217, the number of lifetime prints of each component is stored in a memory, the number of post-replacement prints of each component is counted each time a print is made and is compared with the respective number of lifetime prints and the name of each part whose number of prints coincides with that in the memory is indicated to show when a part's life has ended.

In the prior art electrophotographic recording apparatus, the time of required replacement is known when a component breaks down, but at any given time it is not clear how much longer a component can be used. In addition thereto, the number of post-replacement prints of each component is counted up every printing which thereby increases the writing cycle of the number into the memory. Therefore, the increase in the number of prints leads to a longer printing time.

SUMMARY OF THE INVENTION

An object of the present invention is to provide an electrophotographic recording apparatus in which the rate of wear of components or parts can be known at any time during the operation of the apparatus and in which the frequency of writing the number of prints into a memory can be reduced.

To achieve the object, the electrophotographic recording apparatus according to the present invention comprises: a number of consumable parts; a first storing means for storing a currently integrated total number of prints, and a number of prints at a replacement of each consumable part; a second storing means for storing a number of life time prints, which is a conversion of the life of each part into a number of prints; a first calculating means for calculating a number of prints of replaced consumable parts after such replacement; a second calculating means for calculating a wear rate of the replaced consumable parts from the number of lifetime prints read out from the second storing means, and from the number of prints calculated by the first calculating means; an indication section for indicating the wear rate obtained from the second calculating means; and a writing means for writing the number of prints stored in the first storing means for the consumable parts at replacement into the current total number of prints.

When the electrophotographic recording apparatus structured as described above is operated, the first calculating means for calculating the number of post-replacement prints inputs the contents of the total number of prints and the number of prints at replacement from the first storing means. The first storing means stores the current total number of prints and the total number of prints at replacement individually to calculate the number of post-replacement prints. Next, the second calculating means calculates the wear rate or value from the number of post-replacement prints and the number of lifetime prints stored in the second storing means. The calculated wear rate is indicated by the indication section.

In addition, when a part is replaced because of failure or end of lifetime thereof, the number of prints of the replaced part is changed into the total number of prints at that time by the writing means.

Accordingly, at the replacement of a part, the number of prints of the replaced part is changed to the total number of prints at that time.

Therefore, according to the present invention, the wear rate of the parts (i.e., constituting elements) is constantly indicated on the indication section, thereby allowing the user to know how much longer components or parts can be used.

Further, according to the present invention, in addition to counting-up of the number of prints at the replacement of a part, only the total number of prints is counted up every printing. Thus, the number of writing operations by which the total number of prints will be written in the first storing means at the replacement of a part, is reduced.

BRIEF DESCRIPTION OF THE DRAWINGS

The foregoing and other objects, features and advantages of the present invention will be more fully understood in reference to the following detailed specification and claims taken in connection with the accompanying drawings.

FIG. 4 is a drawing for explaining the number of lifetime prints for each component or part;

DESCRIPTION OF THE PREFERRED EMBODIMENTS

Figure 1:
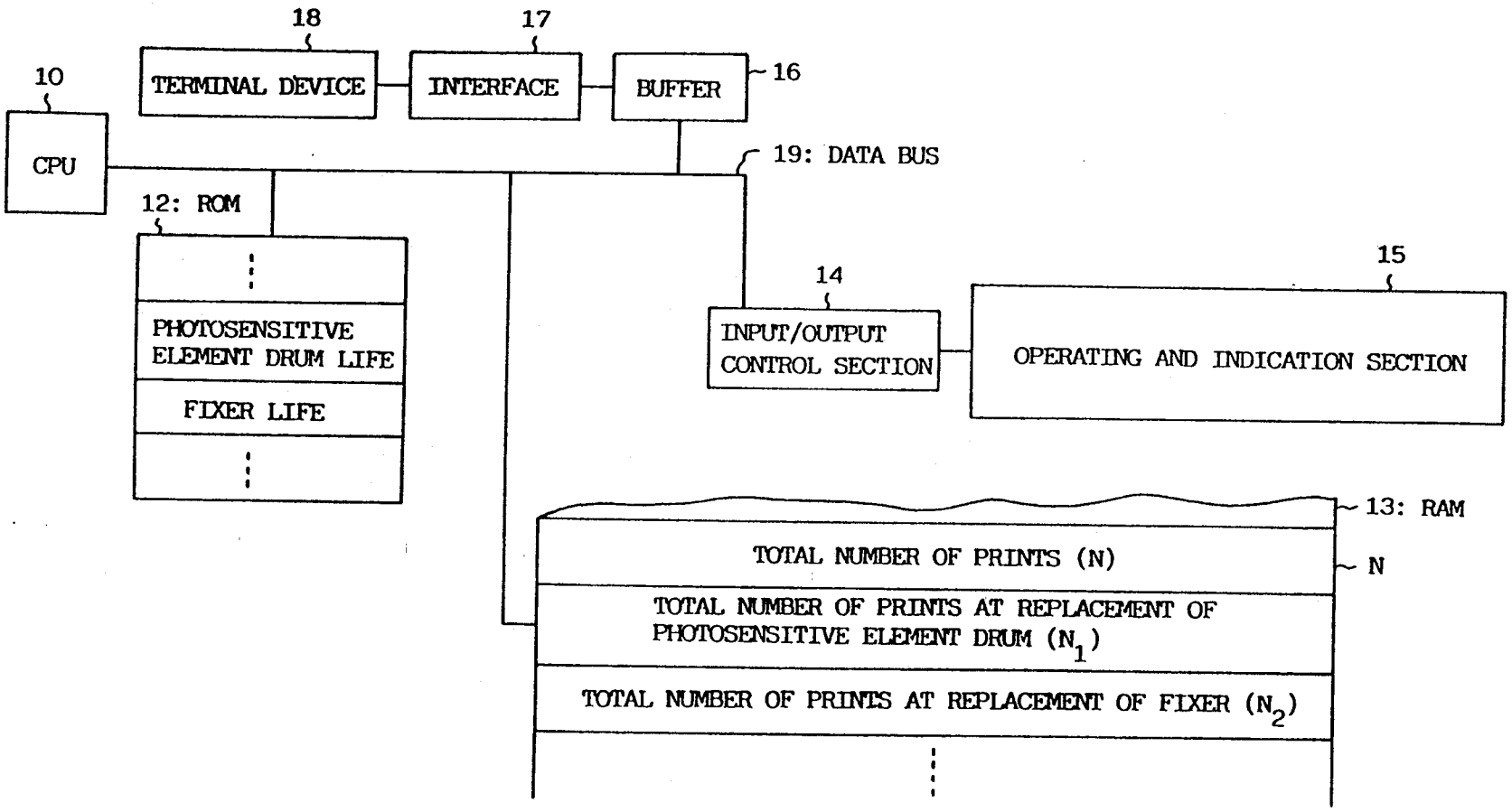
FIG. 1 is a block diagram schematically showing one example of a structure of an electrophotographic recording apparatus according to the present invention.

FIG. 1 is a block diagram schematically showing one example of an electrophotographic recording apparatus according to the present invention.

In FIG. 1, a block 10 shows a CPU which includes the first and second calculating means as calculating sections or accumulators. A block 12 shows the second storing means such, for example, as a read-only memory (ROM) which initially stores the lives of consumable parts or elements (such as photosensitive element drums and fixers) as a value converted into the number of prints. A block 13 shows the first storing means such, for example, as random access memory (RAM) which stores the number of prints when each part is replaced, including the total number of prints N, the number of prints $N_1$ upon replacement of the photosensitive element drum and the number of prints $N_2$ upon replacement of the fixer. A block 14 is an input/output control section and a block 15 is an operation and indication section for data operation and indication. The operation and indication section 15 indicates the names of the number of lifetime and the number of prints of parts.

A block 16 is a receiving buffer connected to a terminal device 18 is an external connection interface 17 to store signals or data from the terminal device 18 temporarily. A line 19 is a data bus through which data among devices and the CPU is exchanged or transmitted.

The RAM 13 is formed by a nonvolatile memory(s) or provided with a back-up power supply for preventing the stored number of prints from being lost when power is removed.

Figure 2:
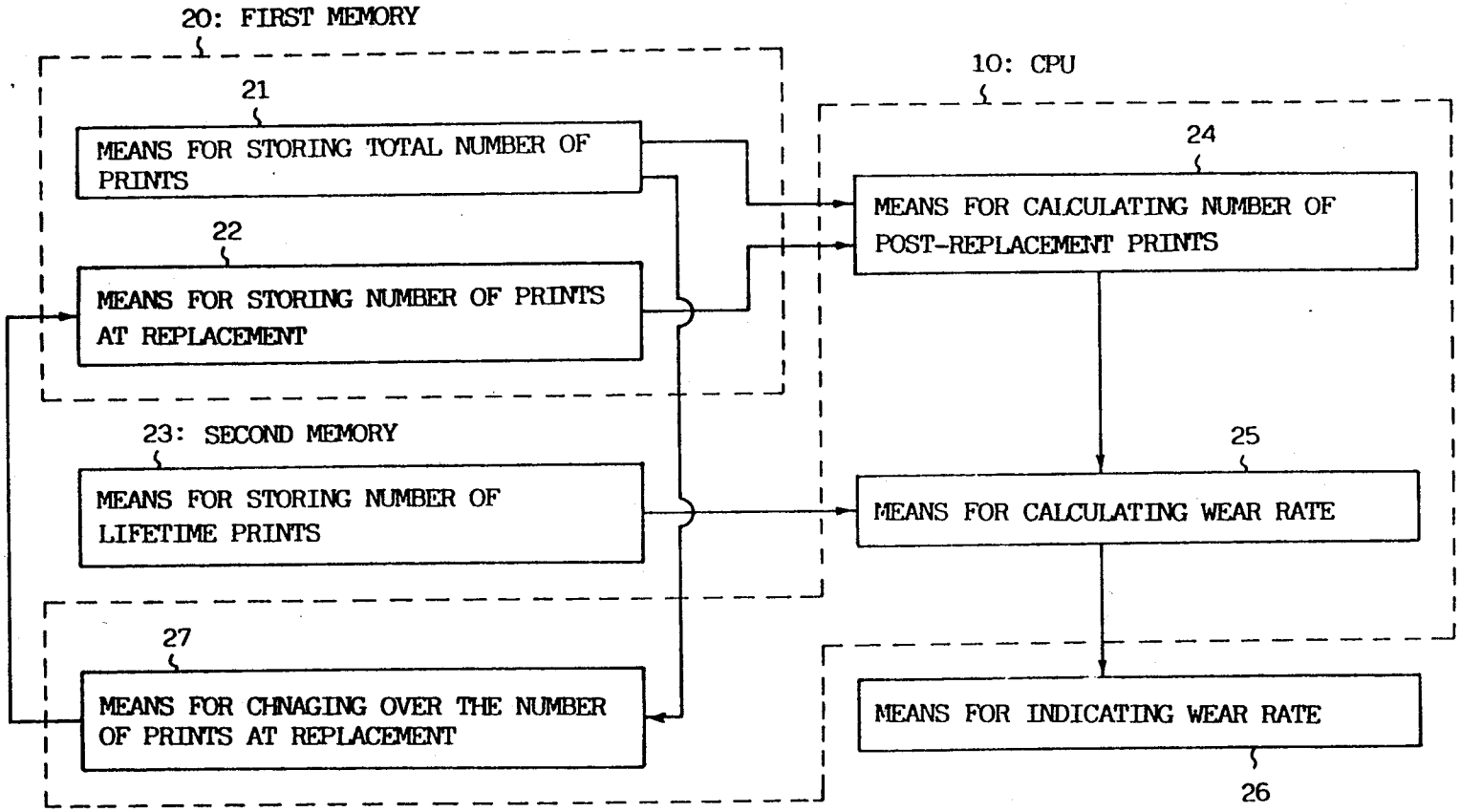
FIG. 2 is a functional block diagram showing the basic structure of the invention.

FIG. 2 is a functional block diagram showing the basic structure of the present invention. The first storing means 13 is shown as first memory 20 which comprises memory means 21 and 22. The memory means 21 stores the total number of prints up to the current time after the electrophotographic recording apparatus is started. The memory means 22 stores the total number of prints at the time when old parts are replaced by new ones, respectively. The second storing means 12 is shown as second memory 23 which stores the number of prints corresponding to the life of the component parts. The first calculating means 24 receives outputs from the memory means 21 and 22, and calculates the number of post-replacement prints by using these outputs. Wear rate calculating means 25 constitutes the second calculating means which receives outputs from the memory means 23 and 24 to calculate the current wear rate or value by using these outputs. Means for indicating wear rate 26 corresponds to the operating and indicating section 15 as shown in FIG. 1. This indicator 26 receives an output from the wear rate calculating means 25 to indicate the wear rate. The switching means 27 is that for changing over the number of prints at the time of replacement of a part. The switching means 27 receives an output from memory 21 and supplies it to memory means 22.

Therefore, this switching means 27 constitutes writing means which writes or updates the number of prints at the time of replacement of a consumable part, into the current total number of prints.

The above-mentioned first storing means (21, 22) corresponds to RAM 13 shown in FIG. 1, the second storing means 23 to ROM 12 shown in FIG. 1, and first calculating means 24, the second calculating means 25 and the switching means 27 are functional means of in the central processing unit (CPU) 10.

Figure 3:
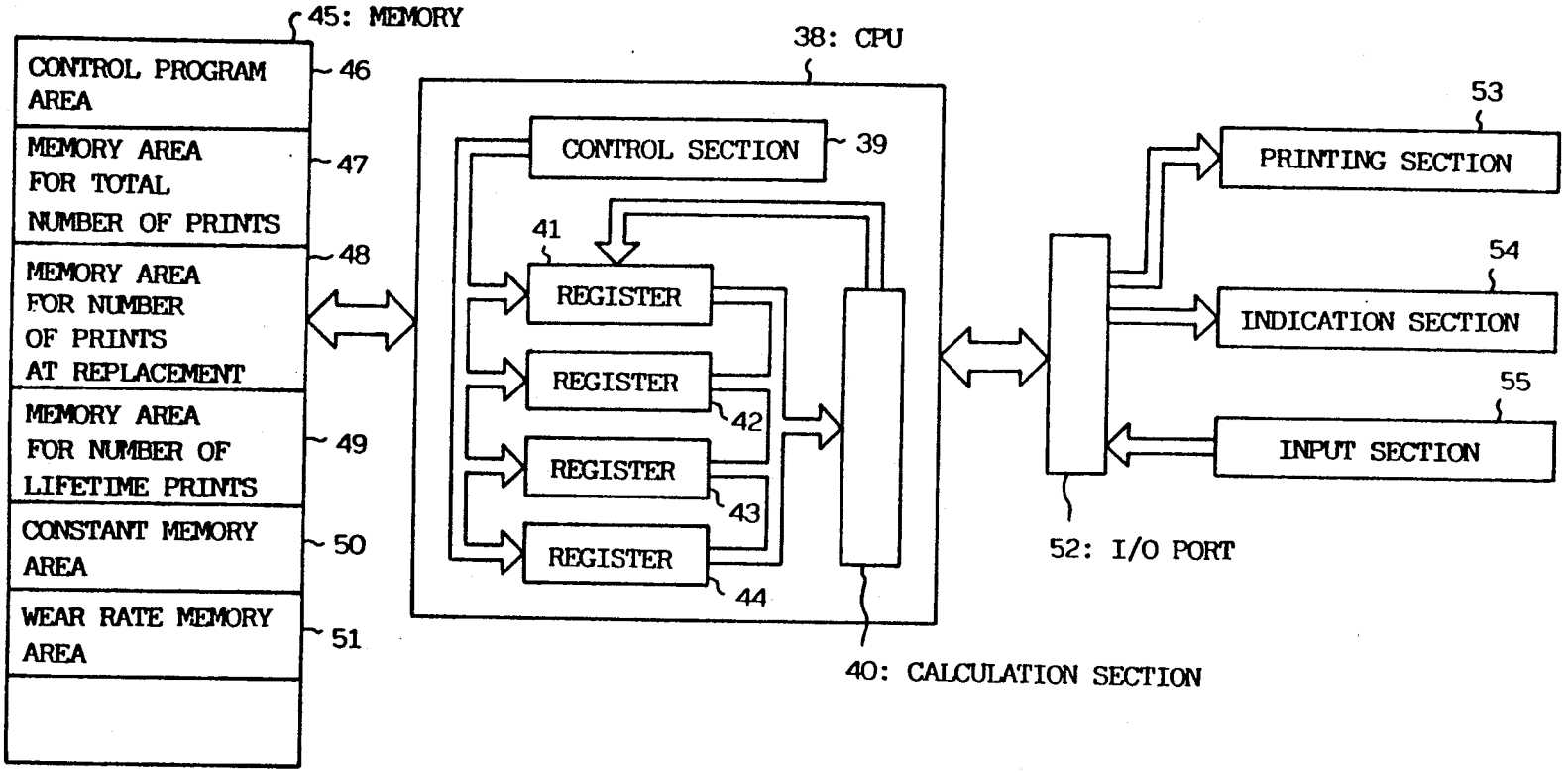
FIG. 3 is a block diagram schematically showing one embodiment of an electrophotographic recording apparatus of the present invention which is constructed by using a microcomputer.

FIG. 3 is a block diagram schematically showing one embodiment of an electrophotographic recording apparatus according to the present invention which is structured by using a microcomputer. The central processing unit 38 (hereinafter called a CPU 38) has connected thereto a memory 45 and an I/O port 52. The I/O port 52 has connected thereto a printing section 53, an indication section 54, and an input section 55. The CPU 38 contains components such as a control section 39, a calculating section 40, and registers (41, 42, 43, 44). These components are connected by lines through which data and signals are transmitted. The memory 45 contains a control program area 46 for storing control program, a memory area 47 for storing the total number of prints, a memory area 48 for storing the number of prints upon replacement, a memory area 49 for storing the number of lifetime prints, a memory area 50 for storing constant values, and a memory area 51 for storing a wear rate(s) or value(s).

FIG. 4 is a drawing for explaining the number of lifetime prints for each component or part. A reference character $A_i$ shows the number of lifetime prints relative to the component parts. For instance, the number of lifetime prints of the photosensitive element is "15000", and that of a charging device is "10000".

Table I shows relations between the total number of prints N and the number of prints $N_i$ at replacement of components. The number of prints $N_i$ at replacement is written on each component relative to the total number of prints N. For instance, the number of prints at replacement of a photosensitive element is expressed by $N_1$, which is "0" when the total number of prints N is less than "15000", and when N=15000, $N_1$ is changed over from "0" to "15000". When N=30000, $N_1$ is again changed from "15000" to "30000".

TABLE I

| | Number of prints at replacement of components $N_i$ | | |
|---|---|---|---|
| Total number of prints N | Photosensitive element $N_1$ | Charging device $N_2$ | Fixer $N_{10}$ |
| 1 | 0 | 0 | 0 |
| 2 | 0 | 0 | 0 |
| 3 | 0 | 0 | 0 |
| . | . | . | . |
| . | . | . | . |
| . | . | . | . |
| 9999 | 0 | 0 | 0 |
| *10000 | 0 | 0 → 10000 | 0 |
| 10001 | 0 | 10000 | 0 |
| . | . | . | . |
| . | . | . | . |
| . | . | . | . |
| 14999 | 0 | 10000 | 0 |
| 15000 | 0 → 15000 | 10000 → 15000 | 0 |
| 15001 | 15000 | 15000 | 0 |
| . | . | . | . |
| . | . | . | . |
| . | . | . | . |
| 24999 | 15000 | 15000 | 0 |
| 25000 | 15000 | 15000 → 25000 | 0 |
| 25001 | 15000 | 25000 | 0 |
| . | . | . | . |
| . | . | . | . |
| . | . | . | . |
| 29999 | 15000 | 25000 | 0 |
| 30000 | 15000 → 30000 | 25000 | 0 |
| 30001 | 30000 | 25000 | 0 |
| . | . | . | . |
| . | . | . | . |
| . | . | . | . |
| 34999 | 30000 | 25000 | 0 |

TABLE I-continued

| Total number of prints N | Number of prints at replacement of components $N_i$ | | |
|---|---|---|---|
| | Photosensitive element $N_1$ | Charging device $N_2$ | Fixer $N_{10}$ |
| 35000 | 30000 | 25000 → 35000 | 0 → 35000 |
| 35001 | 30000 | 35000 | 35000 |
| . | . | . | . |
| . | . | . | . |
| . | . | . | . |

*To be the value at initialization.

Figure 5A:
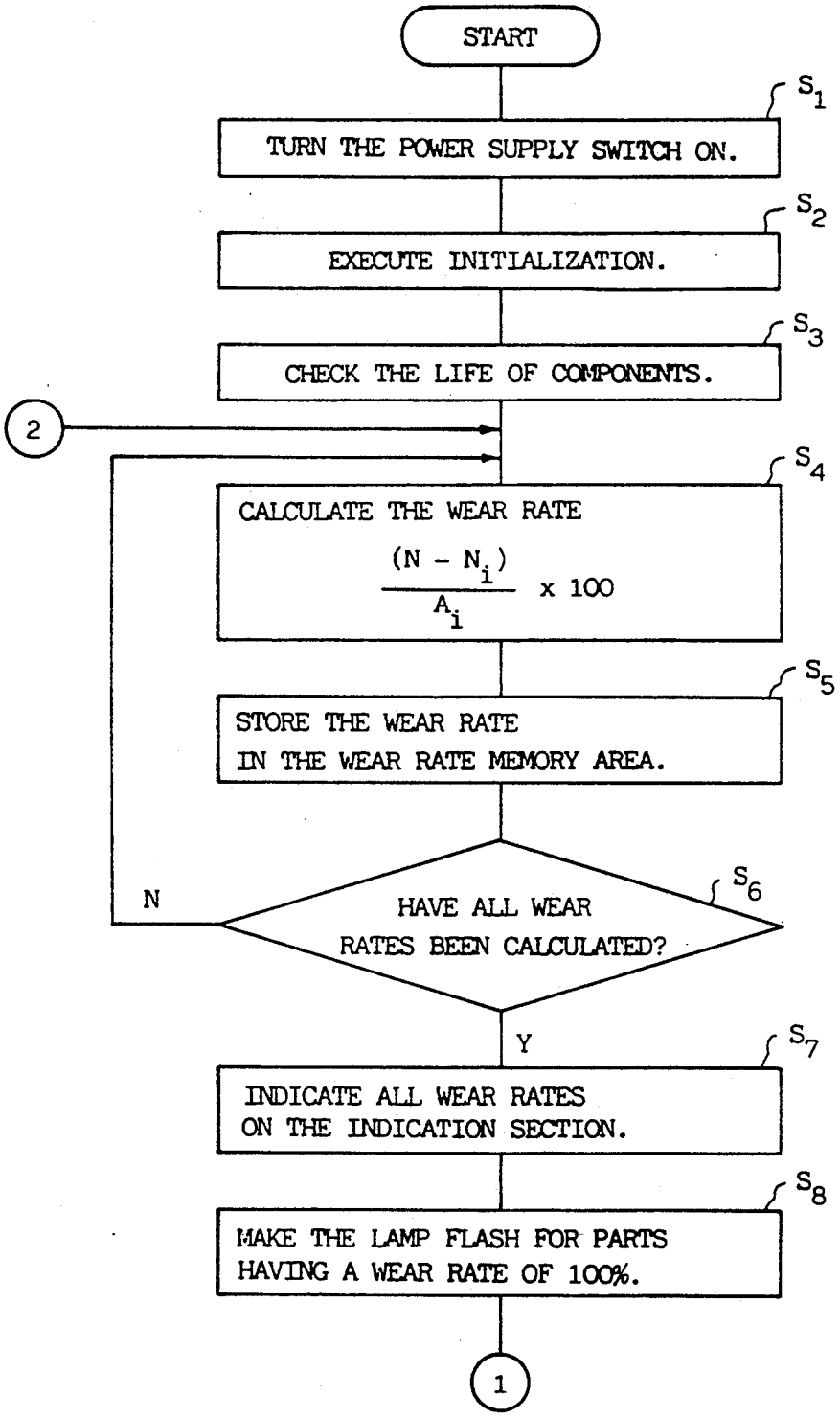
FIGS. 5A and 5B are diagrams showing a flow chart of the printing operation of one embodiment of the present invention.
Figure 5B:
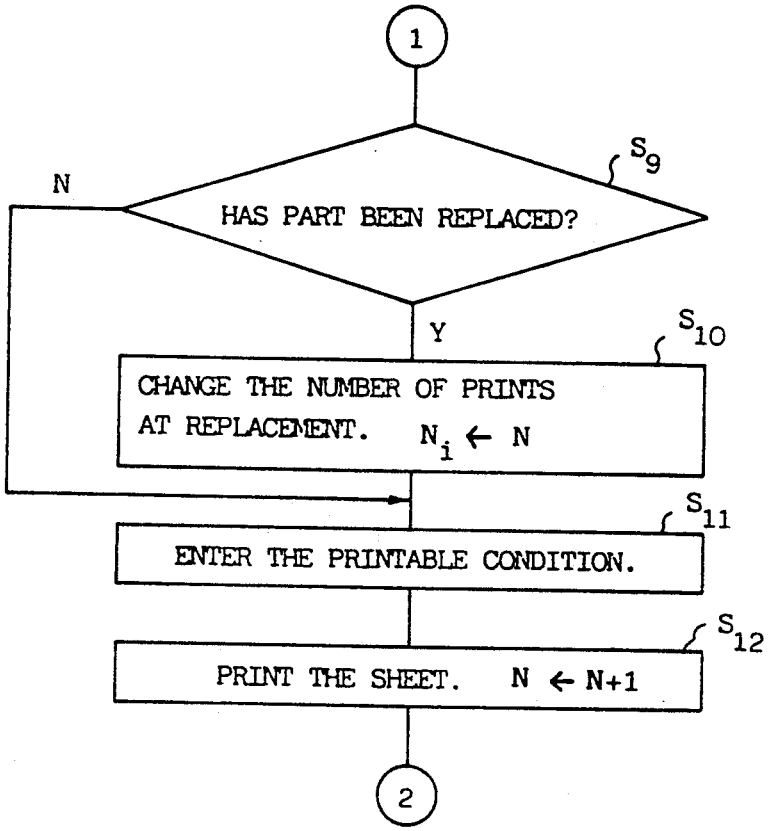

Next, the operation of the embodiment of the invention shown in FIG. 3 is explained with reference to FIGS. 5A and 5B which are diagrams showing a flow chart of the printing operation. At step $S_1$, the power supply switch in the input section 55 is turned on. At $S_2$, the CPU 38 and memory 45 are initialized, and during the initialization process a control program is loaded into the control program area 46 in the memory 45 from an external memory device, which is not shown.

After the control program is loaded, the CPU 38 and the control section 39 perform the operation as hereunder described according to the control program. First, the number of lifetime prints $A_i$, last total number of prints N when the recording device was previously used, the number of prints $N_i$ at the replacement and the constants are loaded from the external memory device into the memory area 47 which stores the total number of prints, the memory area 48 which stores the number of prints at replacement, the memory area 49 which stores the number of lifetime prints, and the constant memory area 50 in the memory 45, respectively. For instance, if the total number of prints N was "10000" immediately before the power supply switch in this device was previously turned off, a figure "10000" is stored as the total number of prints in the memory area 47 which stores the total number of prints, and the memory area 48 which stores the number of prints upon replacement, as shown in Table I, and a figure "0" is stored as the number of prints since replacement of the photosensitive element, charging device, and fixer.

Once loading is completed, the wear rate is calculated for each component part at step $S_4$. For instance, when the wear rate or value of the photosensitive element is calculated, the total number of prints "10000", the number of prints at replacement "0", the number of lifetime prints "15000", and the constant "100" are respectively transferred from the memory 45 to the four registers (41, 42, 43 and 44 shown in FIG. 3) in the CPU 38. Then, the contents of the registers (41 and 42) are input into the calculating section 40, where they are subtracted to calculate the number of post-replacement prints "10000". The number of post-replacement prints "10000" is transferred to the register 41. Next, the contents of the registers 41 and 43 are input into the calculating section 40, where they are divided. The value (0.6666 . . . ) obtained by the division is transferred to the register 41. Next, the contents of the registers 41 and 44 are input into the calculating section 40, where they are multiplied. The result ("66.66 . . . ") is transferred to the register 41. Then, the value "66.66 . . . " registered in the register 41 is stored in the wear rate memory area 51 in the memory 45 at step $S_5$. At the step $S_6$, whether the wear rate has been calculated for all the component parts is checked. If the answer is No, the process returns to step $S_4$, and the wear rate for other components is calculated in the same manner. The result is again stored in wear rate memory area 51 in the memory 45.

At step $S_7$, all the wear rates stored in the wear rate memory area 51 in the memory 45 are transferred to video memory (VRAM), which is not shown, and indicated in the indicating section 54. At step $S_8$, if there is any component part that has reached a wear rate of 100%, an LED lamp, which is not shown, flashes. From the values shown in FIG. 4 and Table I, the wear rate of the charging device is "100%", and so an LED flashes. At step $S_9$, whether the parts have been replaced is checked. If replaced, the process goes to step $S_{10}$, whereas a data write command is input to rewrite the number of prints at replacement $N_i$ for the replaced part from input section 55 upon completion of the replacement. Suppose the charging device is replaced and the data write command is input as the wear rate of the charging device shows "100%". The total number of prints "10000" is transferred to the register 41 in the CPU 38 from the memory area 47, which stores the total number of prints, and then the contents of register 41 "10000" are stored as the number of prints at replacement of the charging device in the memory area 48, which stores the number of prints since replacement in the memory 45. At this time, the LED lamp which has been flashing goes off. The process goes to step $S_{11}$ even if the parts are not replaced in the step $S_9$. An LED lamp keeps flashing in this case. When printing is carried out in step $S_{12}$, the total number of prints N is incremented by "1". After printing, the process is transferred to step $S_4$, where the wear rates of all of the component parts are calculated using the above-described processes, and the result is indicated on the indicating section 54. These processes are repeated as each sheet is printed.

To explain the photosensitive element, when the total number of prints reaches "15000" as shown in Table I, the wear rate is "100%" and the number of prints since replacement $N_1$ is changed from "0" to "15000" as a result of the data re-write command after the parts replacement. The wear rate of the charging device at that time is still "50%", but if the parts are replaced because the charging device has failed, the number of prints since replacement of the charging device $N_1$ changes from "10000" to "15000". And, when the total number of prints reaches "25000", the wear rate is indicated as "100%".

With respect to the accuracy of the wear rate indication, some tolerance margin will have been given to the wear rate and rounded up appropriately when the number of post-replacement prints of individual component parts has reached a respective number of lifetime prints.

The apparatus according to the present invention so structured as described above gives effects as hereunder stated.

Because the wear rate is calculated from the number of post-replacement prints and the number of lifetime prints of the component parts upon initialization or during each print, the degree of wear and tear to the component parts can be identified precisely at all times, thereby facilitating maintenance of the device.

As was previously described, in a prior-art apparatus with a number of consumable items (such as process cartridge and fixer), each having its own lifetime, the number of prints must be counted for each element every time one sheet is printed, resulting in increases in the number of write operations to a memory, and requiring a random access memory with a large capacity. Therefore, the apparatus according to the present invention can preferably be structured as an electrophotographic recording apparatus requiring a reduced number of memory writes, and a smaller capacity RAM.

Figure 6:
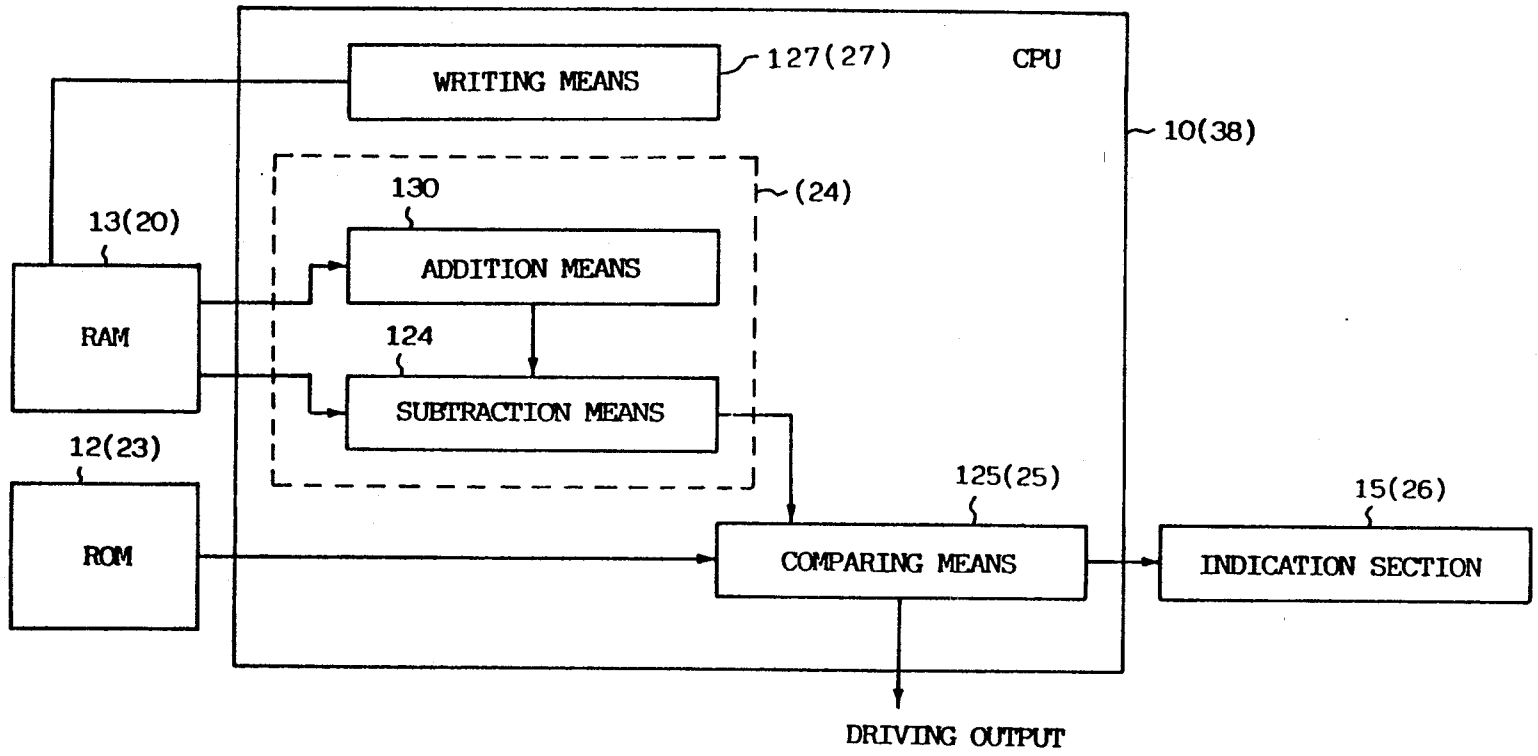
FIG. 6 is a block diagram showing a variation of the functional block showing the basic structure of the present invention.

For this purpose, a variation of the page counting apparatus in the electrophotographic printer of the present invention is shown in FIG. 6. FIG. 6 is a block diagram showing a variation of the functional block of FIG. 3 showing the basic structure of the present invention. The apparatus of this embodiment has a read-only memory 12 for recording the life of at least one element out of the elements or parts (such as the photosensitive element drum, fixer, and conveyor belt), as the value converted into the number of prints, and a random access memory 13 for storing the current total number of prints and the number of prints when each element is replaced, whereas the current total number of prints is increased by "1" as a function of a CPU 10. An adding means is shown by block 130.

In addition, the CPU 10 has a means 124 for calculating the difference between the current total number of prints and the number of prints at the replacement of each element, and a means 125 for comparing the difference with the number of lifetime prints of each element, and the life of an element is indicated on an operating and indication section 15 when the difference exceeds the number of lifetime prints for at least one element.

Further, the device has a means 127 for writing the current total number of prints on the number of prints at replacement stored in the random access memory 13 for an element after replacement of the element.

FIG. 6 shows in the form of a block diagram the relations between each of these means (124, 125, 127 and 130). In FIG. 6, the CPU 10 corresponds to the CPU 38 in FIG. 3. Other numerals used for each corresponding means in FIG. 2 are given in parentheses.

Figure 7A:
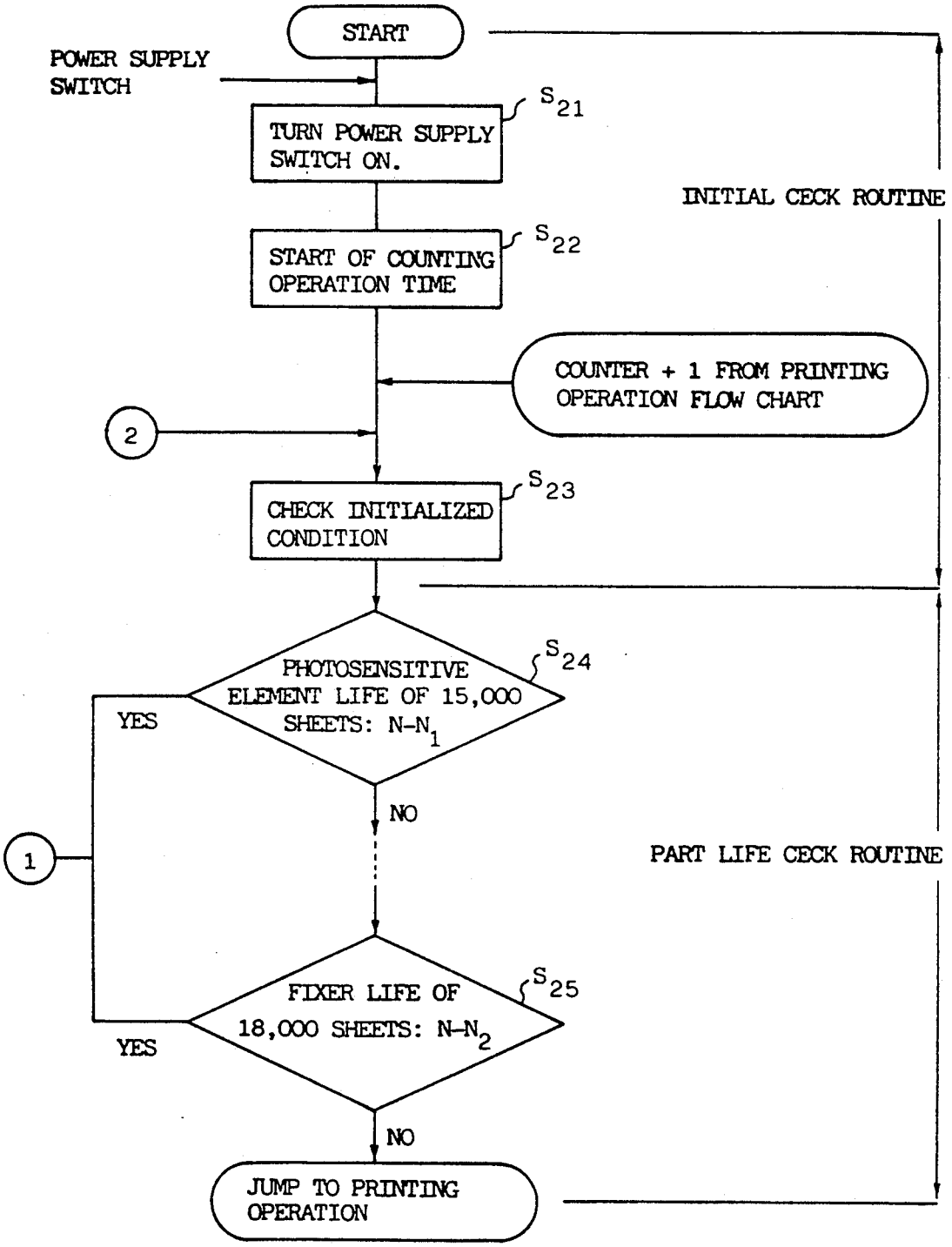
FIGS. 7A and 7B are diagrams showing a flow chart of a page counter in an electrophotographic printer in the electrophotographic apparatus of the present invention.
Figure 7B:
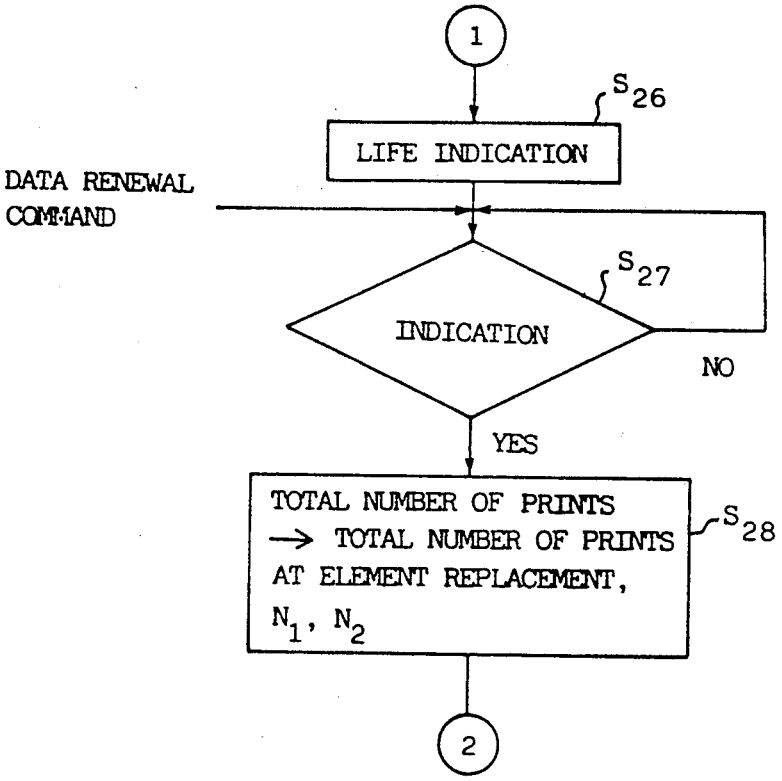

Next, an explanation is given on the operation of the page counting device in the electrophotographic printer of the present invention, with reference to FIGS. 7A and 7B.

FIGS. 7A and 7B are diagrams showing a flow chart of a page counter in an electrophotographic printer in the electrophotographic apparatus of the present invention.

Steps $S_{21}$ through $S_{23}$: Counting of the operations time (number of prints) is started after the power supply is turned on, and the initial conditions are checked.

Steps $S_{24}$ and $S_{25}$: A determination is made on whether the total number of prints N currently stored in the RAM 13 has exceeded the number of lifetime prints for each element such as the photosensitive element drum; and if it is not exceeded, the process proceeds directly to printing operations.

For instance, if the number of prints at replacement of the photosensitive element drum is 15,000, then it is kept as $N_1=15{,}000$. The determination of whether the number of prints for the photosensitive element drum has exceeded the number of lifetime prints is done by judging whether the number of prints by which the number of prints at replacement of the above element $N_1$ is less than the current total number of prints N stored in the RAM 13 has exceeded the number of lifetime prints of each element stored in the ROM 12.

Similarly, if the number of prints at replacement of the fixer is 18,000, then it is kept as $N_2=18{,}000$. The determination of whether the number of prints for the fixer has exceeded the number of lifetime prints is done by judging whether the number of prints by which the total number of prints at replacement of the above element $N_2$ is less than the current total number of prints N stored in the RAM 13 has exceeded the number of lifetime prints of each element stored in the ROM 12.

After printing one sheet, the total number of prints in RAM 13 is increased by "1", and the process returns to the initial condition in step $S_{22}$.

Step $S_{26}$: If there is even one element that has exceeded its number of lifetime prints, it is indicated that the element has terminated its life.

Steps $S_{27}$ and $S_{28}$: After the data renewal command is executed, the corresponding element, that is, the total number of prints at replacement of the part is stored in RAM 13.

As described above in detail, according to the structure employed by the present invention, it is sufficient that only the total number of prints be written each time one sheet is printed, thus allowing the number of writes to a memory to be reduced, and the memory capacity required to be lowered.

The present invention should not be limited to the above embodiments, and it is apparent to those who are familiar with the art that a number of variations or alternative embodiments can be made within the scope of the present invention as defined by the claims.

What is claimed is:

1. An electrophotographic recording apparatus comprising:

(a) a number of consumable parts;

(b) a first storing means for storing a currently integrated total number of prints, and a number of prints at replacement of each consumable part;

(c) a second storing means for storing a number of lifetime prints, which is a conversion of the life of each part into a number of prints;

(d) a first calculating means for calculating a number of prints for replaced consumable parts after such replacement;

(e) a second calculating means for calculating a wear rate of the replaced consumable parts from the number of lifetime prints read out from the second storing means, and from the number of prints calculated by the first calculating means;

(f) an indication section for indicating the wear rate obtained from the second calculating means; and (g) a writing means for writing the number of prints stored in the first storing means for the consumable parts at replacement into the current total number of prints.

2. An electrophotographic recording apparatus as claimed in claim 1, wherein the first storing means is a RAM.

3. An electrophotographic recording apparatus as claimed in claim 1, wherein the second storing means is a ROM.

4. An electrophotographic recording apparatus as claimed in claim 1, wherein the first calculating means, the second calculating means, and the writing means are structured in a central processing unit (CPU).

5. An electrophotographic recording apparatus as claimed in claim 1, wherein the first calculating means is so structured that the calculated values of the difference between the current total number of prints and the number of prints at replacement, which are respectively read out from the first storing means, are output as the number of post-replacement prints.

6. An electrophotographic recording apparatus as claimed in claim 1, wherein the first calculating means is so structured that the current total number of prints read out from the first storing means is incremented by "1" at each printing, and that the calculated difference between the current total number of prints incremented by "1", and the number of prints at replacement read out from the first storing means are output as the number of post-replacement prints.

7. An electrophotographic recording apparatus as claimed in claim 1, wherein the second calculating means is so structured that, when the number of post-replacement prints does not exceed the number of lifetime prints, the difference between both numbers of prints is output as a percentage of the number of lifetime prints, as the wear rate.

8. An electrophotographic recording apparatus as claimed in claim 1, wherein the second calculating means is so structured that, when the number of post-replacement prints is greater than or equal to the number of lifetime prints, the wear rate is output as a signal to indicate that the replaced consumable part has reached the end of its life.

* * * * *